US005263545A

United States Patent [19]

Tudora et al.

[11] Patent Number: 5,263,545

[45] Date of Patent: Nov. 23, 1993

[54] METHOD AND APPARATUS FOR DRILLING HOLES IN SOIL OR ROCK

[75] Inventors: Georg Tudora, Ottendichl; Ralf Porzig, Feldkirchen; Nikolaus Hutte, Olpe, all of Fed. Rep. of Germany

[73] Assignee: Stump Bohr GmbH, Fed. Rep. of Germany

[21] Appl. No.: 926,745

[22] Filed: Aug. 6, 1992

[30] Foreign Application Priority Data

Aug. 14, 1991 [DE] Fed. Rep. of Germany ..... 4126919

[51] Int. Cl.[5] ..... E21B 19/14

[52] U.S. Cl. ..... 175/52; 175/171; 211/70.4; 414/22.66

[58] Field of Search ..... 175/52, 171, 219; 405/232; 211/70.4; 414/22.66

[56] References Cited

U.S. PATENT DOCUMENTS

| | | | |
|---|---|---|---|
| 3,493,061 | 2/1970 | Gyongyosi | 175/52 |
| 3,734,209 | 5/1973 | Hoish et al. | 175/171 X |
| 4,445,579 | 5/1984 | Bello | 175/52 |
| 4,897,009 | 1/1990 | Powell | 414/22.66 |

FOREIGN PATENT DOCUMENTS

| | | |
|---|---|---|
| 1888205 | 12/1963 | Fed. Rep. of Germany . |
| 2435535 | 2/1978 | Fed. Rep. of Germany . |
| 8714952 | 7/1988 | Fed. Rep. of Germany . |
| 785460 | 12/1980 | U.S.S.R. . |

*Primary Examiner*—David J. Bagnell

*Attorney, Agent, or Firm*—Silverman, Cass & Singer, Ltd.

[57] ABSTRACT

A method for drilling holes in soil or rock, especially for producing prestressed ground anchorage. A hole is drilled by a drill column formed of lengths of pipe with a drill bit driven by a rotary and/or percussive drive. The wall of the borehole is supported by a casing formed of lengths of pipe driven by a rotary and/or percussive drive of a drilling tool. The lengths of pipe of the drill column and the casing are taken from a magazine by machine and transferred back to the magazine after drilling the hole. Each length of pipe for the drill column is taken sequentially from the magazine by the drive of the drilling tool for the drill column and each length of pipe for the casing is taken sequentially from the magazine by the drive of the drilling tool for the casing. Each length of pipe for the drill column and each length of pipe for the casing is returned sequentially to the magazine.

23 Claims, 5 Drawing Sheets

METHOD AND APPARATUS FOR DRILLING HOLES IN SOIL OR ROCK

BACKGROUND OF THE INVENTION

1. Field of the Invention

This invention relates to a method for drilling holes in soil or rock, especially for producing prestressed ground anchorage, and drilling equipment for carrying out said method.

2. Description of the Prior Art

Drilling equipment for producing holes for prestressed ground anchorage in soil or rock is known. Such equipment has a crawler truck with a carriage mount connected to articulated arms in such a way that it can be pivoted in all directions in space. A magazine for several lengths of pipe of the drill column is provided on such a drilling tool. The drive for the drill column with the drill bit can be raised and lowered on the carriage and mechanically transfers each length of pipe of the drill column from the magazine. After drilling the holes and before introducing the prestressed ground anchorage, the lengths of pipe of the drill column are returned to the magazine. A disadvantage of this system is that a borehole that can also hold casings to support the wall of the borehole cannot be drilled with such a drilling tool.

There is also a known drilling tool that has a single magazine in which the lengths of pipe of the drill column and the casing are arranged concentrically, one inside the other. A disadvantage of this system is that the lengths of pipe for the drill column and for the casing are unnecessarily long. This complicates the design of the drilling tool and therefore makes it unnecessarily expensive. The concentrically arranged drill column pipes and borehole casing pipes ar taken from the magazine together by a double-head drive for drilling and are transferred to the borehole. After drilling the borehoie, each length of pipe of the drill column must be transferred back to the magazine before the prestressed ground anchorage can be introduced. After the anchor has been introduced, each length of pipe of the drill column is removed from the magazine and then returned to the magazine once again with the length of casing in a concentric arrangement. Returning the length of pipe of the drill column and the casing back to the magazine is tedious and time-consuming, and furthermore, a special drive is necessary for the lengths of pipe.

Known prior art structures always start with designs using a single magazine (see, for example German Patent 24 35 535 C2, German Utility Patents 18 88 205, 87 14 952 U1, U.S. Pat. Nos. 4,897,009, 3,493,061, and Soviet Patent 785,460). This single magazine is used for lengths of pipe for the drill column, so the effectiveness of these known devices is not great.

The present invention solves the problem of providing an apparatus and drilling method for producing boreholes in soil or rock where said apparatus permits simpler handling of the lengths of pipe for the drill column and for the casing and also permits a simpler and therefore less expensive design for the drilling tool. An unnecessary structural height of the drilling tool thereby is avoided.

The invention also provides the advantage that the lengths of pipe of the drill column and the casing can be removed from a magazine separately from each other and in chronological succession and then can be returned to the magazine after drilling the hole for the prestressed ground anchorage. The operation of supplying the lengths of pipe of the drill column and the casing to the magazine is simplified by the present invention.

SUMMARY OF THE INVENTION

According to a preferred embodiment of this invention, separate magazines are used for the lengths of pipe of the drill column and the casing. These magazines are preferably stacked one above the other on the drilling tool. The lengths of pipe are removed one after the other from the magazines which are aligned in the working position and then are retracted back to their outer position. The pipe lengths are transferred by the drives in a concentric arrangement to the drilling position where they are connected to the end of the length of pipe for the drill column and the casing in the borehole. After drilling and casing the borehole for a predetermined length, the drill column is transferred length by length to the respective magazine. Then, the prestressed ground anchor is inserted into the borehole which still holds the casing. Next, the casing is removed length by length and transferred to the respective magazine. The magazines are pivoted into the operating position for this purpose and then are pivoted back to the starting position.

Other embodiments of the invention are described and claimed in the ensuing disclosure.

DESCRIPTION OF THE PREFERRED EMBODIMENTS

Figure 1:
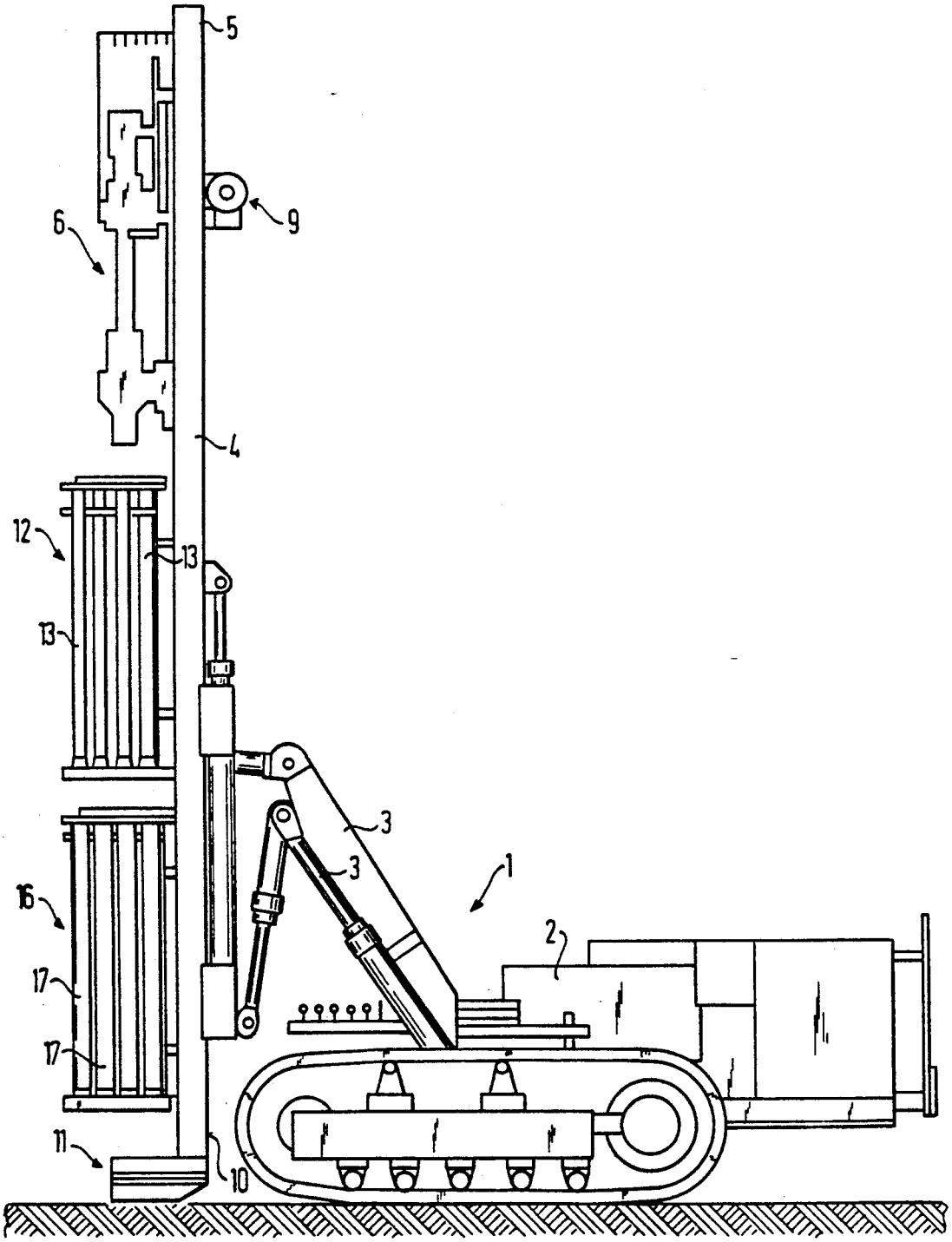
FIG. 1 is a side view of a drilling tool according to the invention.
Figure 2:
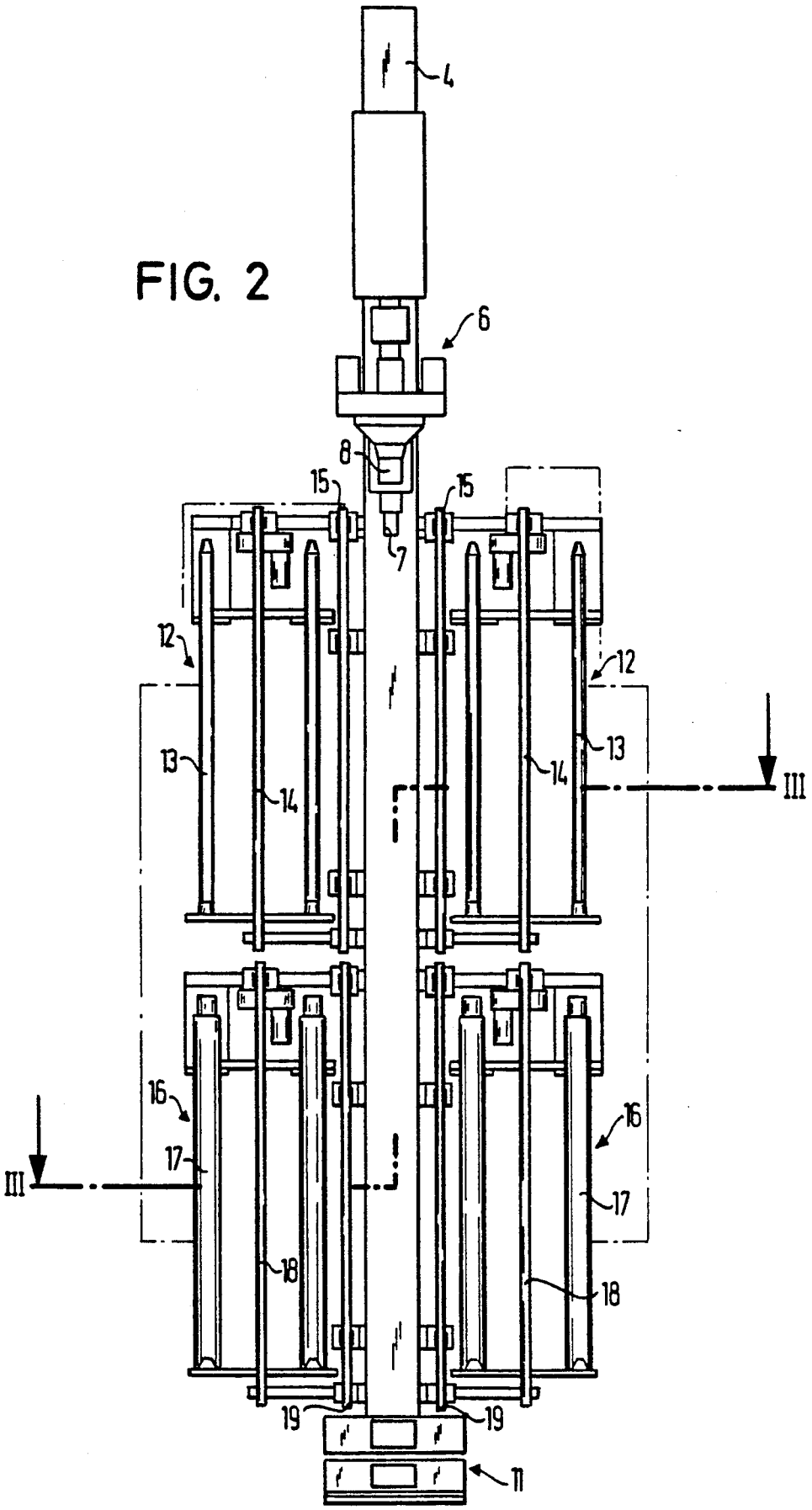
FIG. 2 is a partial frontal view of the tool shown in FIG. 1.

The drilling tool 1 may be provided with a track-laying vehicle 2 with hydraulically operated articulated arms 3, as known. A carriage 4 that can be raised and lowered and pivoted in all directions in space is mounted on the arms 3. Drive 6, which may be a duplex drive or double-head drive, is mounted on the carriage 4. Drive head 7 of drive 6 provides the rotary and/or percussive drive for the drill column with associated drill bit. Drive head 8 of drive 6 provides the rotary and/or percussive drive for the casing, optionally with the drill bit of the borehole when using a double-head drive, for example. With the duplex drive, the casing and drill column are rotated and/or vibrated at the same time.

The drill drive 6 is driven so it can be raised and lowered by a forward drive 9 positioned on carriage 4.

At the lower end 10 of carriage 4 there is a crushing, clamping and guide device 11 for securing, rotating and turning the connections, e.g., threaded connections of the lengths of pipe of the drill column and the casing. Bayonet connections may also be used.

Figure 3:
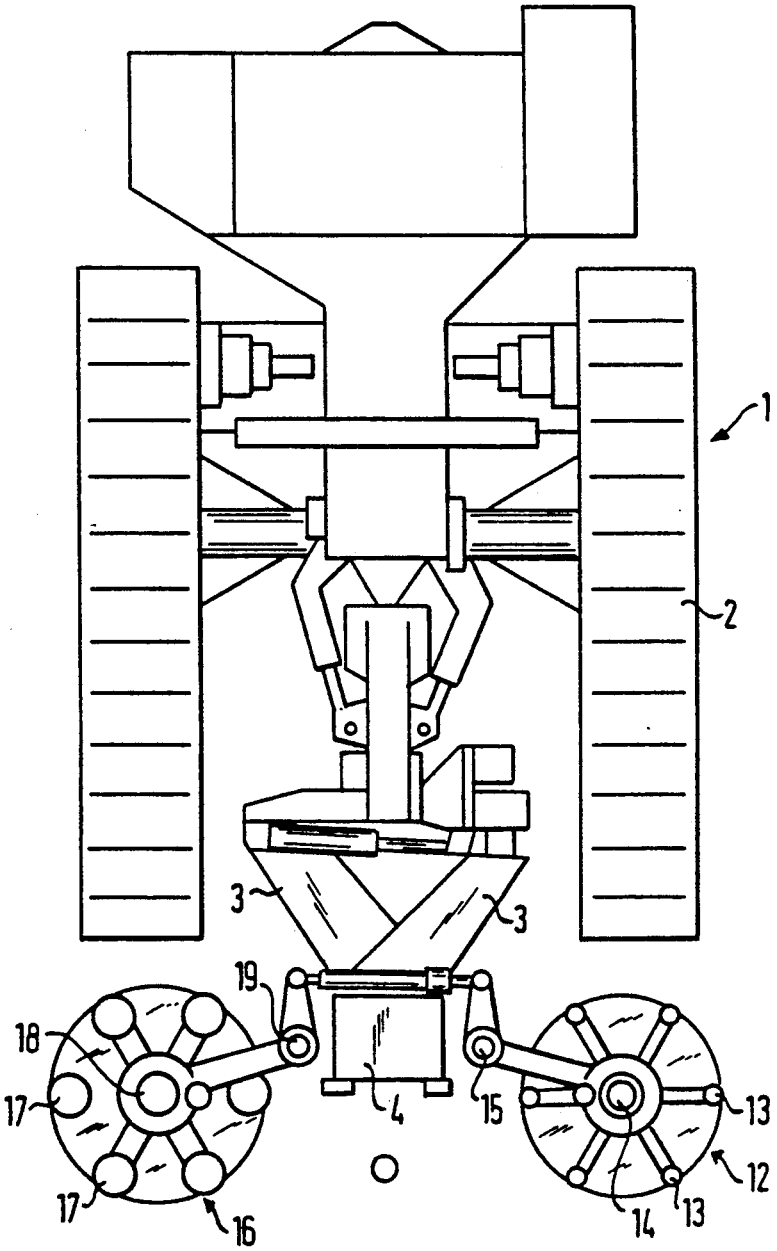
FIG. 3 is a sectional view taken along the line III—III in FIG. 2, in the direction indicated generally.

According to the invention, magazines 12 for the lengths of pipe 13 of the drill column are arranged preferably on both sides next to the carriage. The magazines 12 are designed according to the revolver head principle. Thus, the magazines 12 can rotate about their central axis 14. They hold several lengths of pipe distributed around the periphery so that they can be removed freely toward the outside. Each magazine can be pivoted inward about pivot axis 15 from the outer storage position, as seen in FIG. 3, into a working position (not shown) by means of a pivot drive. In the working position, the drive head 7 can receive the aligned lengths of pipe 13 of the drill column. After receiving the lengths of pipe 13, the magazine is pivoted back into the storage position toward the outside.

Located beneath the magazines 12 for the lengths of pipe of the drill column there are magazines 16 for the lengths of pipe 17 of the casing for the borehole. The magazines 16 are arranged on both sides of the carriage 4 in the same way as magazines 12. The magazines 16 also are designed according to the revolver head principle. They can rotate about the middle axes 18. Magazines 16 hold several lengths of pipe of the casing for the borehole distributed around their periphery in such a way that can be removed freely toward the outside. Each magazine can be pivoted inward into a working position (not shown) from the outer storage position, as seen in FIG. 3, by means of a pivot drive. In the working position, a drive head 7 can hold the aligned respective length of pipe 13 of the drill column. After receiving a length of pipe 13 presented to it, the magazine pivots back to the storage position on the outside.

After a length of pipe 13 has been received by drive head 7, the drilling drive 6 is moved in reverse. Drive head 8 removes from magazine 16 which is in the operating position the aligned length of pipe 17 of the borehole casing which surrounds coaxially the length of pipe 13 of the drill column. Then the drive 6 moves downwardly after returning magazine 16 to its storage position. Lengths of pipe 13 and 17 are permanently connected in a known manner with the drill column or casing already in the borehole by using the crushing, clamping and guide device 11. Next, the rotary and/or percussive drive of drilling drive 6 is operated.

After finishing the borehole, first the drill column is dismantled length by length. The lengths of pipe 13 of the drill column are then moved to the height of magazines 12. Magazines 12 are then pivoted into position. Lengths of pipe 13 are then transferred to a fitting position in magazine 12. Next, the magazines are returned back to their storage position on the outside.

Thereafter, the prestressed ground anchor is installed in the borehole which still contains the casing. Then the casing is dismantled length by length. The lengths of pipe 17 of the casing are transferred to magazines 16 in a manner similar to that described above.

In order for the length of the carriage not to be too great and the drilling tool not to be too heavy, it is advisable to select a length of about 2 meters for lengths of pipe 13, 17.

Essentially, it is also possible to accommodate the lengths of pipe 13 for the drill column and the lengths of pipe 17 for the casing side by side in a single magazine. The magazines need not be provided on the drilling tool itself either. They can also be set up at nearby locations, e.g., other vehicles.

Figure 4:
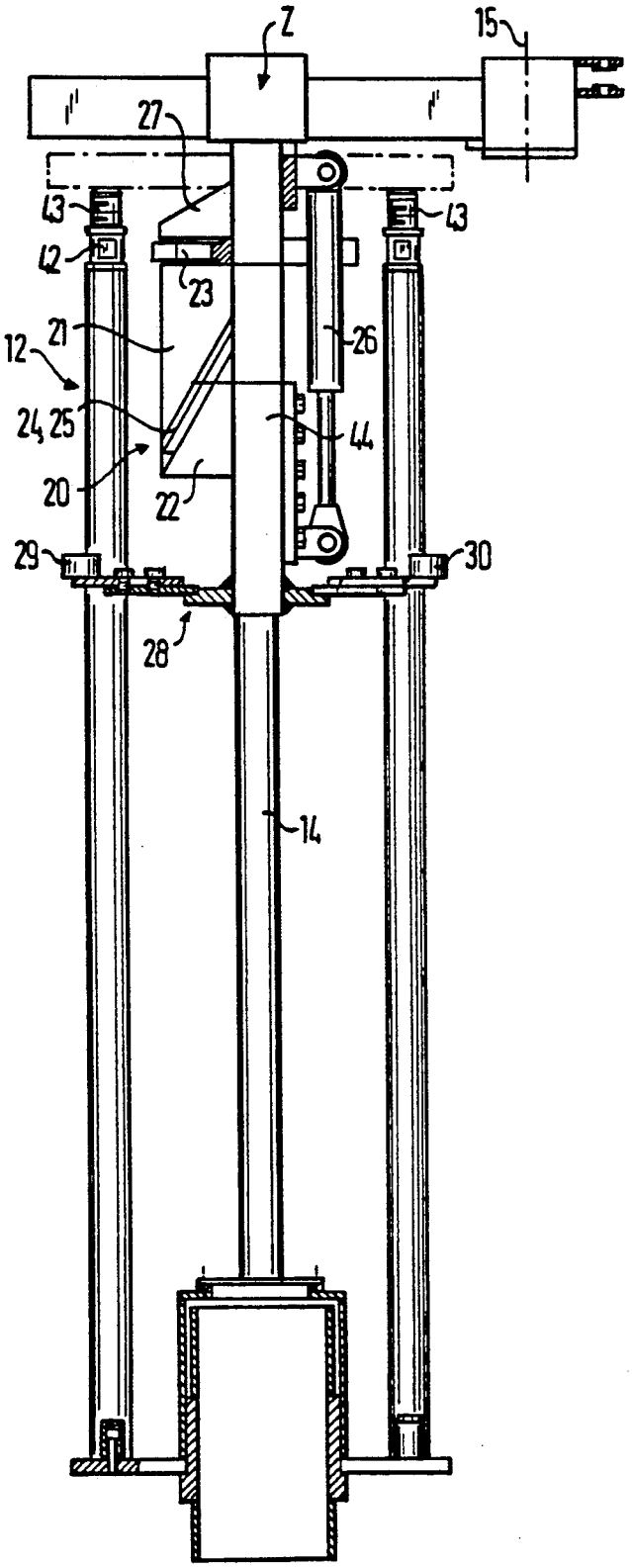
FIG. 4 is a schematic side view of a magazine with a locking device.

When magazine 13 is pivoted out of its storage position, as seen in FIG. 3, into the working position by rotating it about swivel axis 15, one length of pipe 13 is positioned coaxially beneath drive head 7. The drive head 7 must then be functionally connected to the proper length of pipe 13. For this purpose, the respective magazine 13 may have a locking device 20, as seen in FIG. 4, that is capable of holding the length of pipe 13 of the drill column which is in the working position in a secure manner so that it cannot twist as the drive head 7 is connected to the length of pipe 13, e.g., by means of a screw connection. The length of pipe 13 may have a thread 43 in the upper area onto which the drive head 7 is screwed.

Figure 6:
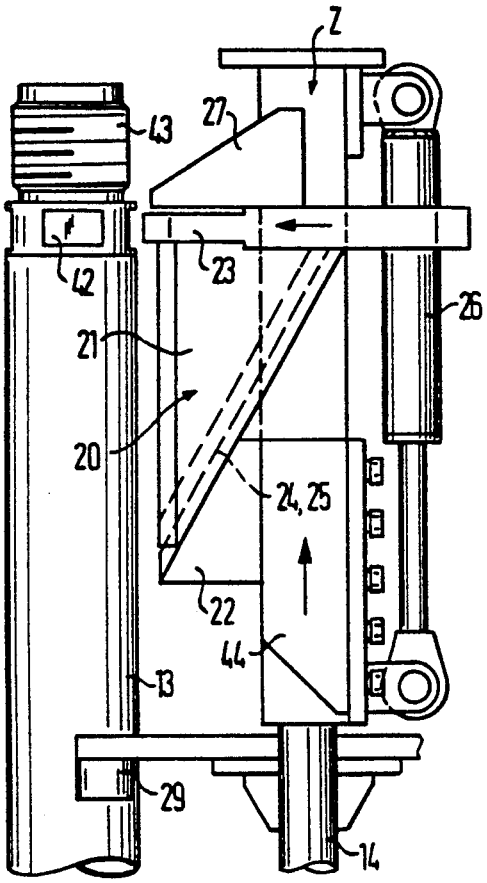
FIG. 6 is an enlarged schematic view of the locking device in retracted position.
Figure 7:
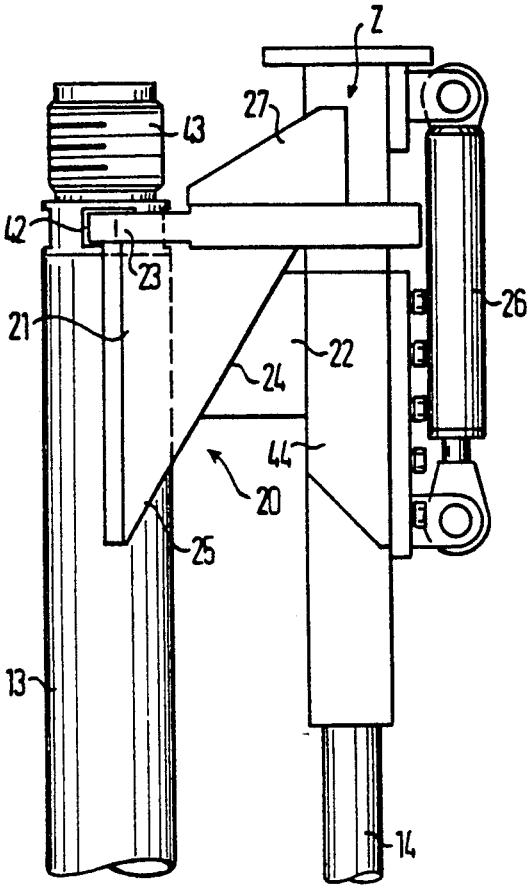
FIG. 7 is a view similar to FIG. 6, with the locking device in a forward position.

As seen in FIGS. 4, 6 and 7, the locking device 20 consists of two elements 21 and 22, each of which has sliding inclines 24 and 25 that cooperate together. The first element 21 is provided with a key-shaped lock 23 beneath guide 27, so that the front area of the key-shaped lock is in a position to engage in a corresponding key-shaped surface 42 on the outer periphery of length of pipe 13. Below the key-shaped lock 23, the first element 21 of locking device 20 is designed so that it can slide by the outer circumference of a length of pipe 13 on both sides.

The second element 22 is attached to a carriage 44, which is arranged in the central area Z of the respective magazine 12 or 16 so that it is adjustable in height on the middle axis 14 or 18. The carriage 44 is connected to a piston-cylinder unit 26 that is supported in the central area Z of the respective magazine.

FIG. 6 shows locking device 20 in the retracted position. When the piston-cylinder unit 26 shown in FIG. 7 is operated, the carriage 44 is shifted upwardly on axis 14 so that the first element 21 is advanced over the second element 22 and the sliding surface 24 is advanced over the sliding surface 25 in the direction of the arrow to the right until the front side of the key-shaped lock 23 engages in the key surface 42 and thus secures length of pipe 13 which is in the operating position so that it cannot twist. Guide 27, which is securely connected to central area Z, serves here as a mating surface during the process of sliding the first element 21.

Then the drive head 7 can be lowered from above and connected to length of pipe 13 by means of thread 43 so that it cannot twist. After creating this connection, the piston-cylinder unit 26 is actuated again, so that the locking device 20 moves back out of the position illustrated in FIG. 7 into the position illustrated in FIG. 6. Length of pipe 13 is moved by means of drive 6 and drive head 7 down into the range of magazine 16 where the lengths of pipe 17 of the casing are held. Like the embodiment described above, these magazines also each have a locking device 20, so that the length of pipe 17 of the casing in the working position is connected in the same way to drive head 8 so it cannot twist.

After connecting length of pipe 13 to the pipe projecting out of the ground and after similarly connecting length of pipe 17 to the part of the drill column projecting out of the ground, drive heads 7 and 8 are detached from the respective pipes 13 and 17 by means of device 11 and returned to their starting positions.

After finishing the borehole, the lengths of pipe are moved back into the area of the respective magazines after they are first loosened by device 11 and the screw connection. Again, the corresponding locking device 20 is operated to finally disconnect the respective drive heads 7 and 8 and pipes 13 and 17, and it hold pipes 13 and 17 which are in working position in the respective magazine area until the connection between these pipes and the respective drive heads 7 and 8 has again been released. The lengths of pipe are thus moved back out of the working position into the storage position within the respective magazine 12 or 16.

Figure 5:
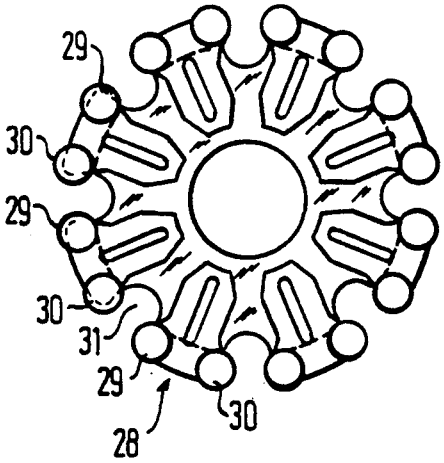
FIG. 5 is a top view of a roller guide.

In order to satisfactorily hold and guide the lengths of pipe 13 and 17 in the respective magazines 12 and 16, the respective center axis 14 can be provided with a roller guide 28, as seen in FIG. 4. As seen in FIG. 5, the roller guide 28 has two coaxial rollers 29 and 30 surrounding a guide slot 31 on both sides. Thus, the respective length of pipe 13 or 17 can be guided between the respective rollers 29 and 30 within the guide slot 31, and this provides a firm bearing.

Figure 8:
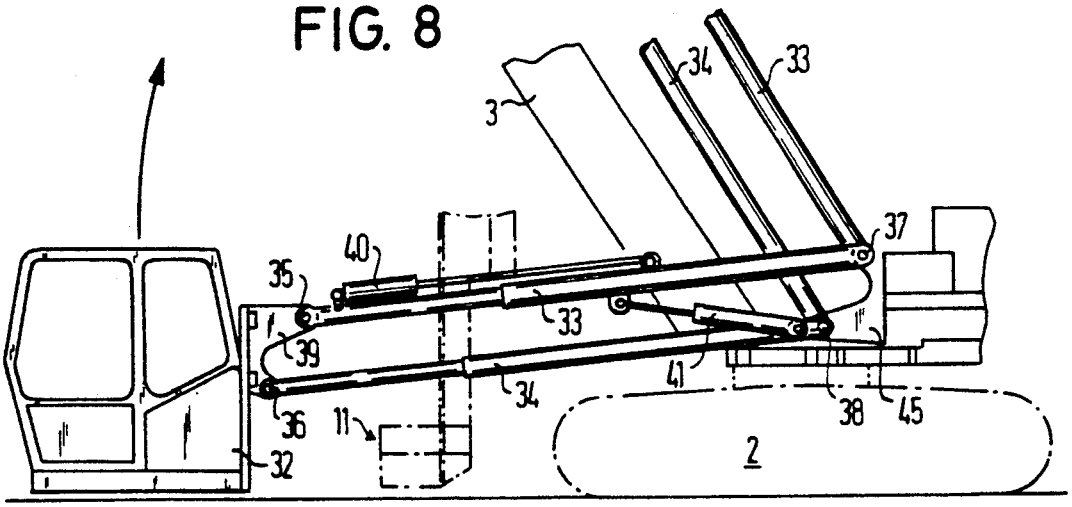
FIG. 8 is a schematic side view of a working platform.

As seen in FIG. 8, it is possible to provide the track-laying vehicle 2 with a working platform 32 that can be raised and lowered by means of articulated arm 33 and 34 in the area of carriage 4. The articulated arms 33 and 34 are part of a four-bar linkage with a coupler 39 and a bearing mount 45 next to the articulated arms 3 on the track-laying vehicle 2. This is a double rocker with the two articulated arms 33 and 34 and with coupler 39, and a total of four joints 35, 36, 37 and 38 are provided. The working platform 42 is attached to the rocker 39.

Between the two articulated arms 33 and 34, there is a piston-cylinder unit 41 with one arm arranged on the housing while the other arm is connected to articulated arms 33. When the piston-cylinder unit 41 is actuated, the two articulated arms 33 and 34 pivot upwardly, so that the working platform 32 moves in the direction of the arrow by means of coupler 39.

Coupler 39 is held by a piston-cylinder unit 40 on articulated arm 33 in a position that assures that the working platform 32 will always be in a horizontal plane. For this purpose, the two articulated arms 33 and 34 are designed like a telescope. The operation of the drilling tool according to the invention can be controlled and monitored reliably by means of the working platform 32.

We claim:

1. Method for drilling a borehole in the ground with a drilling column formed of first lengths of pipe and driven by a drilling tool, the wall of the borehole being supported by a casing formed of second lengths of pipe and driven by said drill tool, the first and second lengths of pipe being removed from a magazine and returned thereto after drilling the borehole, said method comprising the steps of:

removing each first length of pipe and each second length of pipe one after the other, and transferring each first length of pipe and each second length of pipe to the magazine in succession.

2. Method as claimed in claim 1 in which there are two magazines and each first length of pipe is removed from one magazine and each second length of pipe is removed from the other magazine and the lengths of pipe are returned to their respective magazines.

3. Apparatus for drilling a borehole in the ground comprising, a carriage, a drive for a drill column mounted on the carriage and adapted to be raised and lowered thereon, the drill column being formed of lengths of pipe with a drill bit, a drive for casings mounted on the carriage and adapted to be raised and lowered thereon, the casings being formed of lengths of pipe, at least one magazine for multiple lengths of drill column pipes, said at least one magazine being movable from an exterior storage position to a working position in which one length of drill column pipe is aligned with said drill column drive, and at least another magazine for multiple lengths of casing pipes, said at least other magazine being movable from an exterior storage position to a working position in which one length of casing pipe is aligned with said casings drive.

4. Apparatus as claimed in claim 3 in which the magazines are arranged on both sides of the carriage.

5. Apparatus as claimed in claim 4 in which the magazines are arranged one above the other.

6. Apparatus as claimed in claim 4 in which each at least one magazine is arranged above each at least other magazine.

7. Apparatus as claimed in claim 4 in which each magazine is of generally revolver-head formation with a middle axis and a pivot axis, said pivot axis being disposed generally parallel to the longitudinal axis of the carriage, said magazines being rotatable about their respective middle axis.

8. Apparatus as claimed in claim 3 in which the magazines are arranged one above the other.

9. Apparatus as claimed in claim 8 in which each at least one magazine is arranged above each at least other magazine.

10. Apparatus as claimed in claim 8 in which each magazine is of generally revolver-head formation with a middle axis and a pivot axis, said pivot axis being disposed generally parallel to the longitudinal axis of the carriage, said magazines being rotatable about their respective middle axis.

11. Apparatus as claimed in claim 3 in which each at least one magazine is arranged above each at least other magazine.

12. Apparatus as claimed in claim 3 in which each magazine is of generally revolver-head formation with a middle axis and a pivot axis, said pivot axis being disposed generally parallel to the longitudinal axis of the carriage, said magazines being rotatable about their respective middle axis.

13. Apparatus as claimed in claim 3 including at least one locking device for holding a length of pipe from said magazines.

14. Apparatus as claimed in claim 13 in which the locking device is operable mechanically.

15. Apparatus as claimed in claim 14 in which the elements each have a sliding slope.

16. Apparatus as claimed in claim 13 in which each magazine has a locking device that can be pivoted from the storage position to the working position and back again.

17. Apparatus as claimed in claim 13 in which the locking device includes two elements with interacting sliding surfaces, one element including a key-shaped locking portion movable horizontally by vertical movement of the other element.

18. Apparatus as claimed in claim 17 in which the other element is mounted in a central area of its respective magazine and is movable vertically by action of a pistoncylinder unit and a carriage.

19. Apparatus as claimed in claim 18 in which the central area of each magazine includes at least one roller guide for a length of pipe.

20. Apparatus as claimed in claim 19 in which each length of pipe is retained in a guide slot between two coaxial rollers.

21. Apparatus as claimed in claim 17 in which at least one guide is positioned above the key-shaped locking portion.

22. Apparatus as claimed in claim 3 including a track laying vehicle having a working platform supported by articulated arms, said working platform being adopted to be raised or lowered by said arms in the area of the carriage.

23. Apparatus as claimed in claim 22 in which the arms are part of a four-bar linkage.

* * * * *